United States Patent [19]

Halasz et al.

[11] 4,241,573

[45] Dec. 30, 1980

[54] REEL CLAMP FOR A CRADLE ASSEMBLY

[75] Inventors: Joseph Halasz; Rokuzo Ito, both of Toronto, Canada

[73] Assignee: Canada Wire and Cable Limited, Toronto, Canada

[21] Appl. No.: 12,705

[22] Filed: Feb. 16, 1979

[51] Int. Cl.[3] ..... D07B 7/06; D07B 3/02

[52] U.S. Cl. ..... 57/127.7; 57/65; 57/127.5; 242/129.6

[58] Field of Search ..... 57/65, 66, 66.5, 127.5, 57/127.7, 58.32; 242/129.5–130

[56] References Cited

U.S. PATENT DOCUMENTS

| | | | |
|---|---|---|---|
| 2,177,812 | 10/1939 | Robbins et al. | 57/127.7 |
| 2,690,642 | 10/1954 | Van Hook | 57/127.7 X |
| 2,860,479 | 11/1958 | Wheater | 57/127.7 X |
| 2,958,178 | 11/1960 | Crosby et al. | 57/127.5 |
| 2,972,854 | 2/1961 | Bruestle | 57/65 |
| 4,079,580 | 3/1978 | Varga | 57/127.5 |
| 4,130,985 | 12/1978 | Varga | 57/127.5 |

*Primary Examiner*—John Petrakes
*Attorney, Agent, or Firm*—Fleit & Jacobson

[57] ABSTRACT

A reel clamp for a cradle assembly is disclosed. The reel clamp comprises two pintle assemblies mounted in axial alignment, one of such pintle assembly being axially movable with respect to the other. Each pintle assembly includes a bearing housing, a reel supporting member rotatably mounted in the bearing housing and means for securing the bearing housing to one of the side frame members of the cradle assembly. Cam means are associated with the movable pintle assembly for moving the bearing housing of such movable pintle assembly along the axis of the reel for clamping the reel between the two reel supporting members.

6 Claims, 11 Drawing Figures

REEL CLAMP FOR A CRADLE ASSEMBLY

This invention relates to a reel clamp for a cradle assembly.

As it is well known, cradle assemblies are used in cable stranding machines for the making of cables composed of a plurality of twisted wires or wire strands. There are two types of stranding machines, namely the tubular stranding machines and the planetary type stranding machines. The tubular stranding machines comprise a large tube within which a number of cradles are mounted on the same axis whereas the planetary stranding machines comprise a number of cradles mounted on axes parallel to the main axis of the machine. In both types of stranding machines, the reels are mounted on the cradles and such reels must be replaced when empty. It is therefore important to be able to replace an empty reel rapidly and also to be able to safely lock the reels in position as they are relatively heavy and could cause a lot of damage if they became loose. The commonly known reel clamp uses two pintle assemblies, one of which is movable to permit insertion and clamping of the reel therebetween. Various mechanisms are used to move one of the pintles and to clamp them in position but such mechanisms are generally complex and costly.

It is therefore an object of the present invention to provide a reel clamp mechanism which is simple and of a relatively low cost as compared to the existing mechanisms.

The reel clamp, in accordance with the invention, comprises:

(a) a first pintle assembly including a first bearing housing, a first reel supporting member rotatably mounted in the first bearing housing and means for securing the first bearing housing to one of the side frame members of the cradle assembly;

(b) a second pintle assembly mounted in axial alignment with the first pintle assembly and including a second bearing housing, a second reel supporting member rotatably mounted in the second bearing housing and means for mounting the second bearing housing on the other side frame member of the cradle assembly; and (c) cam means associated with the second pintle assembly for moving the second bearing housing along the axis of the reel for clamping the reel between the first and second reel supporting member.

The cam means preferably comprises a profiled groove cut in the circumference of the bearing housing of the second pintle assembly, a cam actuator engaging the groove, and means for rotating the cam actuator around the axis of the second pintle assembly to move the second bearing housing axially toward the first bearing housing.

The means for mounting the bearing housing of each pintle assembly is preferably a flanged cylinder secured to its associated side frame member. The bearing housing of the fixed pintle assembly is fixed to its associated cylinder but the bearing housing of the movable pintle assembly is axially movable within its associated cylinder. The cylinder has a groove of predetermined length cut perpendicularly to its axis. The cam actuator protrudes through such groove and is secured to a collar rotatably mounted on the outside surface of the cylinder. A ring is secured to the collar and a lever is in turn secured to the ring for rotating the ring which in turn rotates the collar and the cam actuator.

Each reel supporting member preferably includes a shaft journalled in bearings mounted in the bearing housing and a holder disc coupled to the shaft and forming a seat for the core of the reel. The shaft preferably has a splined portion engaging a mating splined portion of the holder disc. A push rod is mounted coaxially within the shaft and contacts the disc. A spring engages the push rod for resiliently mounting the holder disc with respect to the shaft.

One of the holder discs is preferably provided with a brake assembly and such holder disc is further provided with a drive pin engaging the reel to prevent relative movement of the reel with respect to the holder disc.

The invention will now be disclosed, by way of example, with reference to the accompanying drawings in which.

Figure 1:
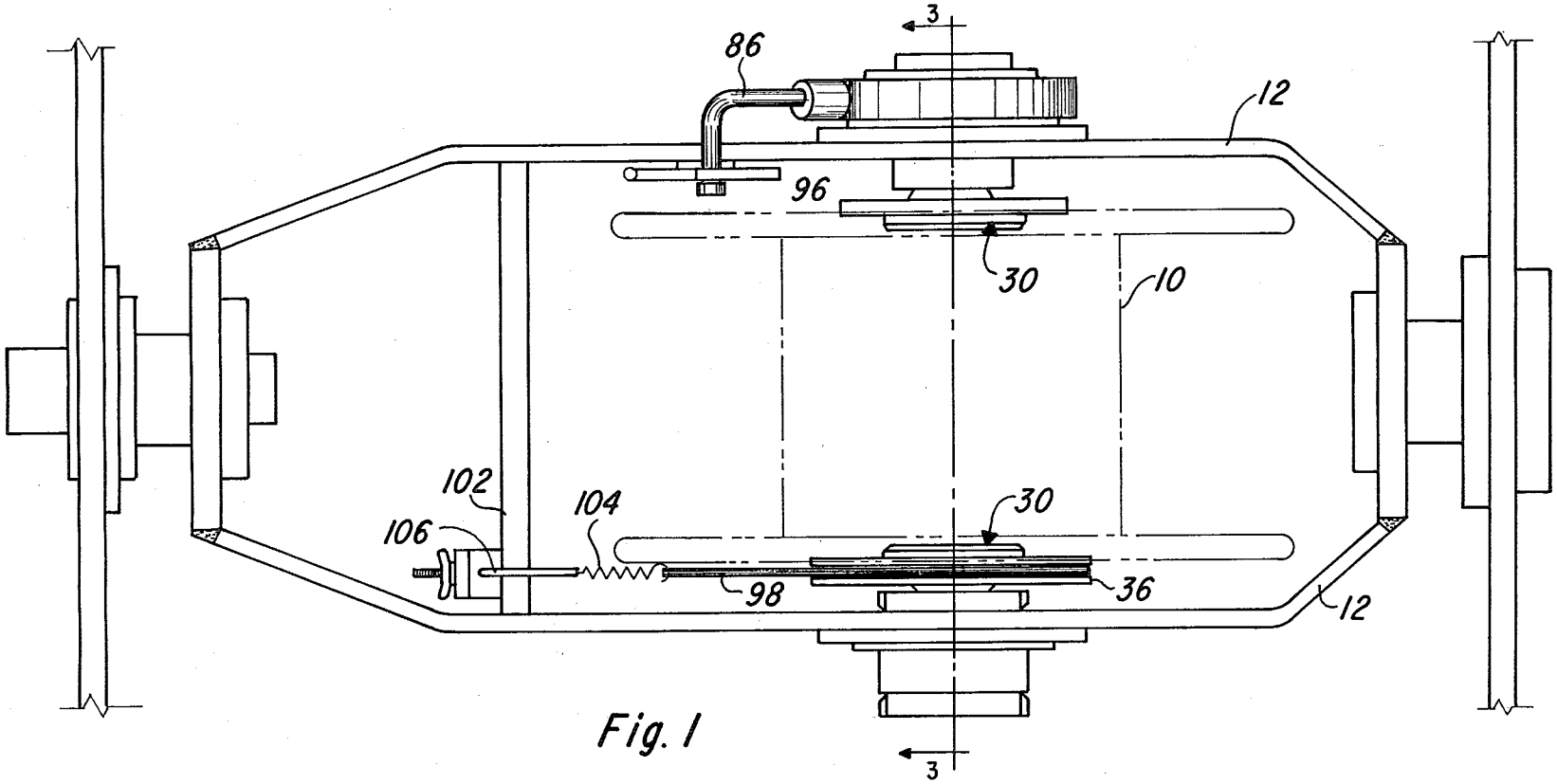
FIGS. 1 and 2 illustrate a plane and a partly sectional sideview, respectively, of a cradle assembly in accordance with the invention.
Figure 2:
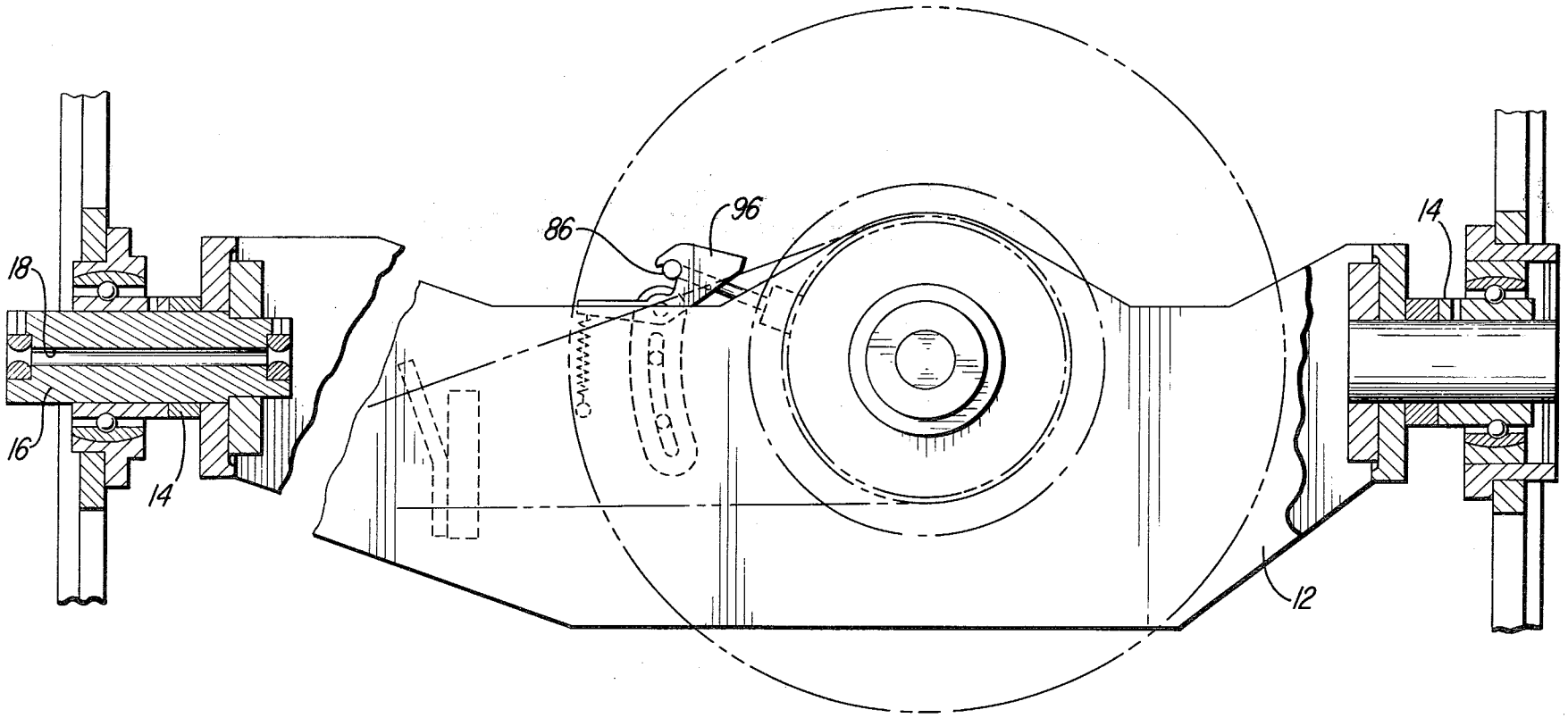

Referring to FIGS. 1 and 2, there is shown a cradle assembly for supporting a reel 10 in a tubular strander. The cradle assembly comprises a pair of side frame members 12 mounted for rotation in suitable bearing members 14. One of the main shafts 16 of the bearing members is hollow as shown at 18 to pass the wire wound on the reel 10.

Figure 3:
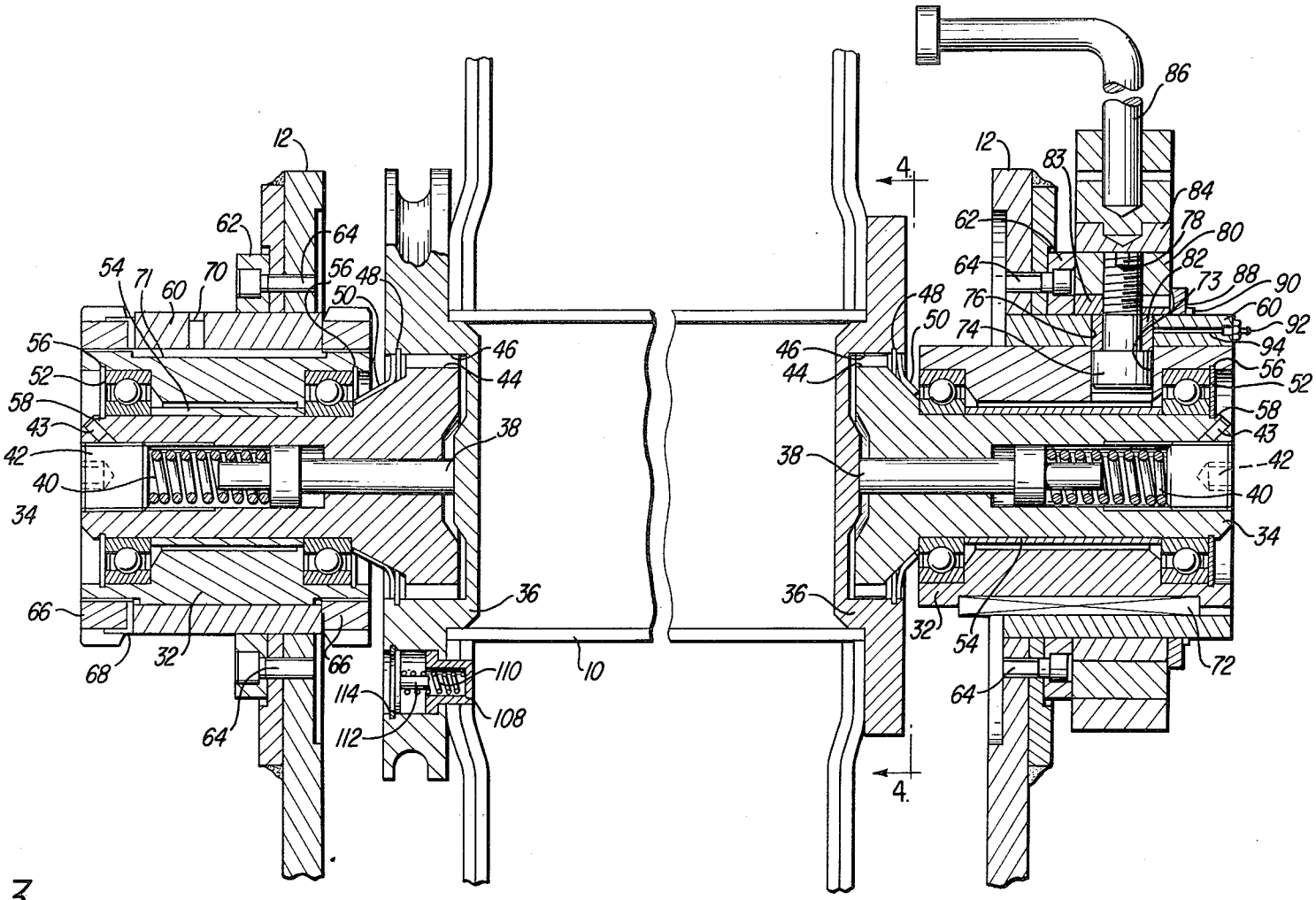
FIG. 3 illustrates a section view through line 3—3 of FIG. 1.
Figure 4:
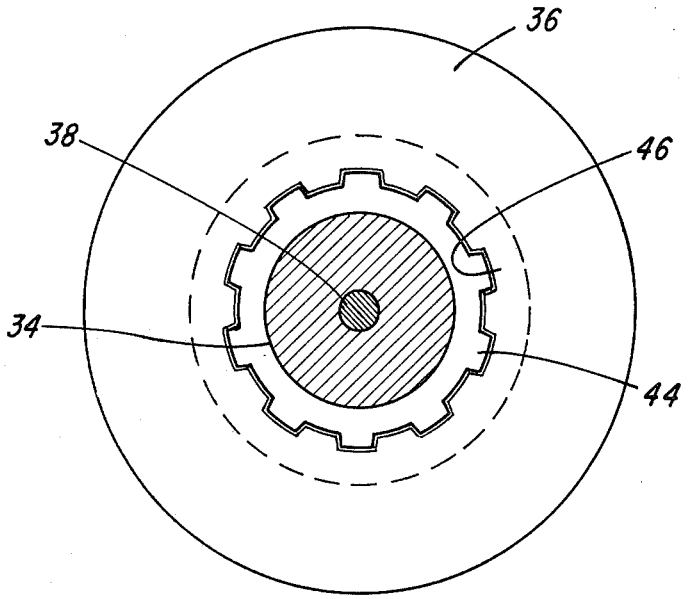
FIG. 4 illustrates a section view along line 4—4 of FIG. 3 with the rubber packing removed.

The reel 10 is clamped between two pintle assemblies 30 which are more clearly shown in FIG. 3 of the drawings. Each pintle assembly includes a bearing housing 32 and a reel supporting member comprising shaft 34 and a holder disc 36 which forms a seat for the core of the reel 10. The holder disc 36 is resiliently mounted on shaft 34 by means of push rod 38 which is mounted coaxially with the shaft and biased by a spring 40 which in turn is backed up by a tap screw 42 itself locked in position by screw 43. As more clearly seen in FIG. 4, shaft 34 has a splined portion 44 which matches a corresponding splined portion 46 in the holder disc so as to permit coupling of shaft 34 with holder disc 36 while permitting a limited axial movement of the matching parts. The movement of shaft 34 under the influence of spring 40 is limited by retaining ring 48. A rubber packing 50 prevents entry of dust in the gears 44 and 46. Shaft 34 is journalled in bearing 52 which are located in bearing housing 32. A cylindrical spacer 54 separates the bearings 52 on shaft 34. The bearings are locked in position in housing 32 and on shaft 34 by retaining rings 56 and 58.

Figure 10:
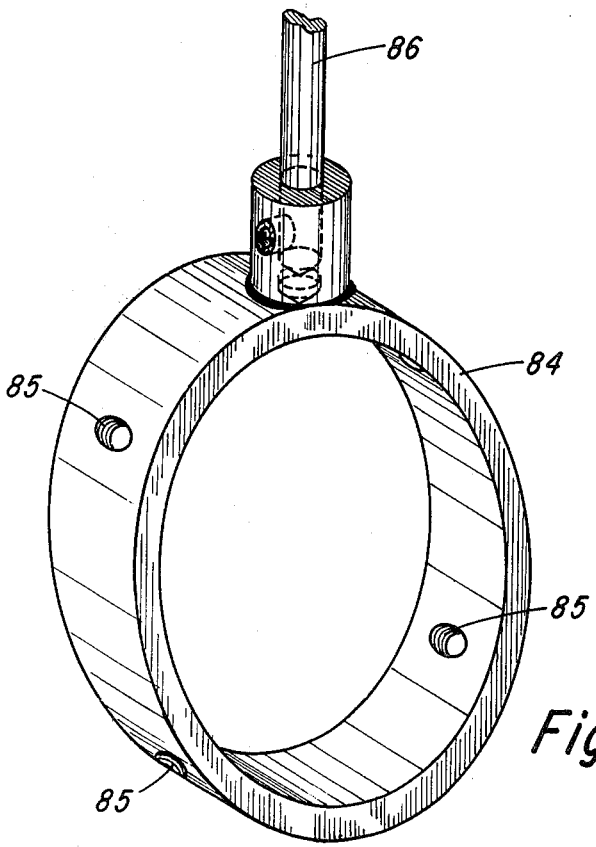
FIG. 10 illustrates a ring which is to be secured to the collar of FIG. 9.
Figure 5:
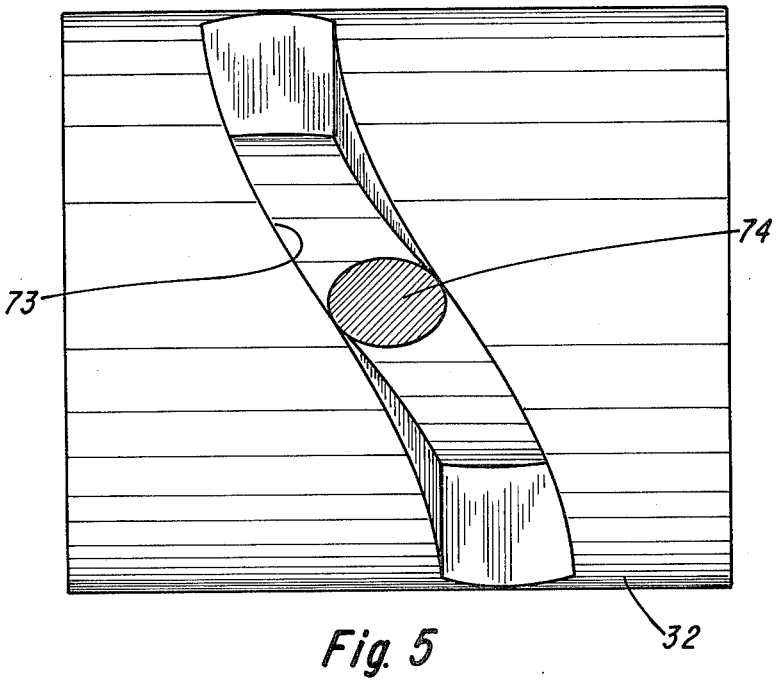
FIGS. 5 and 6 illustrate a plane and an end view, respectively, of the bearing housing of the movable pintle assembly.
Figure 6:
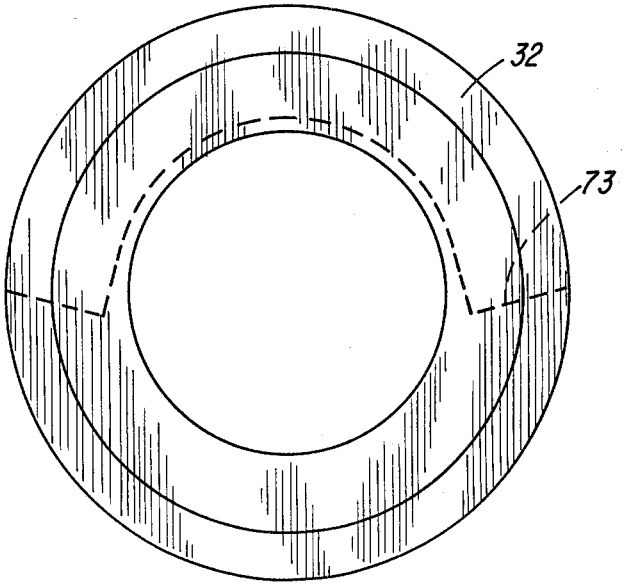
Figure 7:
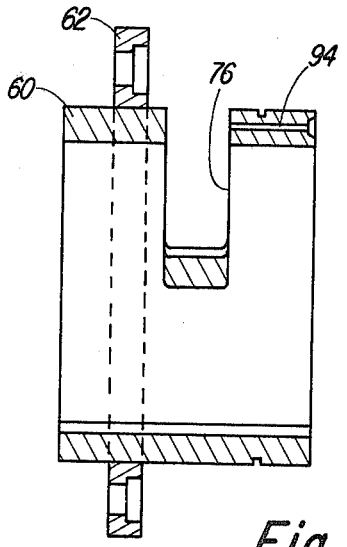
FIG. 7 illustrates a plane view of the cylinder supporting the bearing housing of the movable pintle assembly.
Figure 8:
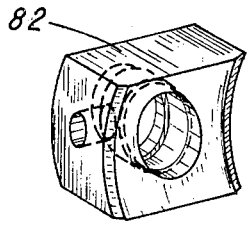
FIG. 8 illustrates a bushing which engages the cylinder of the movable pintle assembly.
Figure 9:
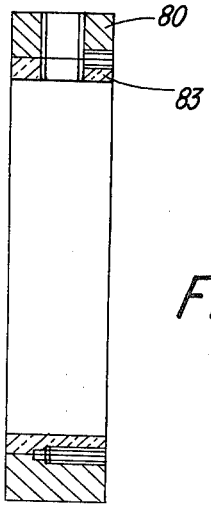
FIG. 9 illustrates a collar surrounding the cylinder of the movable pintle assembly.

Each pintle assembly is mounted within a cylinder 60 having a flange 62 welded thereto. The flange 62 of each cylinder is secured to the side frame 12 by means of bolts 64. The left hand pintle bearing housing of FIG. 3 is axially fixed in position by means of locknuts 66 which are threaded on bearing housing 32. A tab washer 68 is positioned between locknut 66 and cylinder 60. Rotary movement of bearing housing 32 with respect to cylinder 60 is prevented by tap screw 70 engaging slot 71 in the outer surface of bearing housing 32. The right hand pintle of FIG. 3 is axially movable within its associated cylinder 60 but is prevented from rotating by means of key 72 engaging corresponding keyways in bearing housing 32 and cylinder 60. As more clearly seen in FIGS. 5 and 6, the right hand bearing housing 32 has a groove 73 having a predetermined profile which extends over an angle of about 150° C. in the circumference of the housing and is designed to receive the end of a cam actuator 74. As shown in FIG. 7, another groove 76 is cut into cylinder 60 perpendicularly to its axis. Cam actuator 74 includes a pin 78 which is passed through groove 76 and threaded into a collar 80 which is rotatably mounted on the outside circumference of cylinder 60. A bushing 82, more clearly shown in FIG. 8, is mounted on pin 78 for engagement with groove 76. Bushing 82 and at least the inside portion 83 of collar 80 (shown in FIGS. 3 and 9) are normally made of bronze to facilitate sliding of these parts. As shown in FIGS. 3 and 10, a ring 84 is secured to collar 80 by tap screws threaded through holes 85 and rotation of such ring 84 is carried out by a lever 86. The collar 80 is held from longitudinal movement with respect to the axis of cylinder 60 by means of a spacer 88 and retaining ring 90. The cam actuator and bushing 82 are lubricated by a grease fitting 92 through conduits 94 in cylinder 60.

Figure 11:
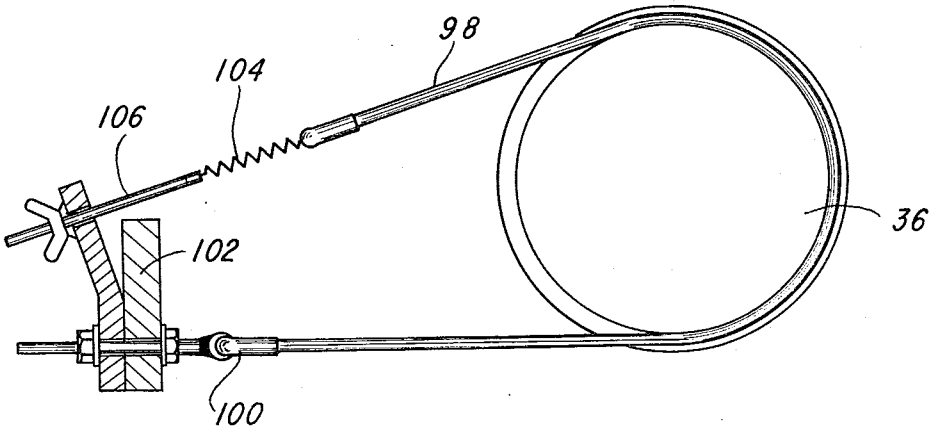
FIG. 11 illustrates the brake assembly of the fixed pintle.

As shown in FIGS. 1 and 2, the lever 86 is locked in position by locking device 96 mounted on one of the side frames 12. As also shown in FIG. 11, the fixed pintle assembly is provided with a brake assembly consisting of a friction belt 98 passing around a groove in holder disc 36. One end of the belt is secured by means of attachment 100 to a transverse member 102 joining frame members 12. The other end of the belt is attached to a spring 104 which is itself secured to transverse member 102 by means of attachment 106.

The holder disc of the reel supporting member of the fixed pintle assembly is provided with a drive pin 108 which is biased by a spring 110. The spring is held in position by a rod 112 having a head sliding into a hole in the holder disc. The head of the rod is retained in position by retaining ring 114.

The operation of the reel clamp may be best understood with reference to FIGS. 1 and 2. When it is desired to remove an empty reel, the locking device 96 is rotated clockwise and lever 86 is then freed and rotated clockwise by about 150° C. from the position illustrated in FIG. 1. In so doing, the cam actuator rides in groove 73 to move the bearing housing 32 and holder disc 36 out, thus freeing the reel. The empty reel can then be taken out and a full one put back in. The lever 86 is operated in the opposite direction to lock the new reel in position. When the tubular stranding machine is put back in operation, the drive pin 108 falls into a corresponding hole in the reel during the first turn of the reel and any further slipping of the reel with respect to the reel supporting member is prevented.

Although the invention has been disclosed with reference to a preferred embodiment thereof, it is to be understood that various modifications may be made to such embodiment within the scope of the following claims. For example, other types of cam arrangements could be used to move the bearing housing of the movable pintle assembly with respect to the axis of the reel. Also other means of actuating the cam can also be envisaged.

What is claimed is:

1. A reel clamp for a cradle assembly having a pair of side frame members comprising:

(a) a first pintle assembly including a first bearing housing, a first reel supporting member rotatably mounted on two axially spaced bearings located within said bearing housing and means for securing said first bearing housing to one of said frame members;

(b) a second pintle assembly mounted in axial alignment with said first pintle assembly and including a second bearing housing, a second reel supporting member rotatably mounted on two axially spaced bearings located within said bearing housing and means for mounting said second bearing housing on the other side frame member; and (c) cam means associated with said second pintle assembly for moving said second bearing housing back and forth along the axis of said reel for clamping and unclamping said reel between the first and second reel supporting members, said cam means comprising a profiled groove cut in the circumference of the bearing housing of the second pintle assembly over a predetermined length thereof, a cam actuator including a cam roller engaging said groove, and means for rotating said cam actuator around the axis of said second pintle assembly to cause said cam roller to move said second bearing housing axially with respect to the first bearing housing.

2. A reel clamp as defined in claim 1, wherein said means for mounting said first or said second bearing housing on its associated side frame member is a flanged cylinder secured to its associated side frame member.

3. A reel clamp as defined in claim 2, wherein the cylinder of the movable pintle assembly has a groove of predetermined length cut perpendicularly in the wall of the cylinder, and wherein said cam actuator includes a pin which protrudes through said groove, and wherein said means for rotating said cam actuator includes a collar slidably mounted on the outside surface of the cylinder and to which said pin is secured, a ring secured to said collar, and a lever for rotating said ring.

4. A reel clamp as defined in claim 1, wherein each reel supporting member includes a shaft journalled in said bearings, and a holder disc coupled to said shaft and forming a seat for the core of the reel and means for resiliently mounting said holder disc with respect to said shaft.

5. A reel clamp as defined in claim 4, wherein said shaft has a splined portion engaging a mating splined portion of the holder disc, and wherein said means for resiliently mounting said holder disc with respect to said shaft comprises a push rod mounted coaxially within said shaft and contacting said holder disc, and a spring mounted on said shaft and engaging said push rod.

6. A reel clamp as defined in claim 4, wherein one of said holder disc is provided with a brake assembly and wherein said one holder disc is further provided with a drive pin engaging said reel to prevent relative movement of the reel with respect to the holder plate.

* * * * *